United States Patent [19]

Clark

[11] 4,275,750

[45] Jun. 30, 1981

[54] SELF-CONTAINED TOOTHBRUSH

[76] Inventor: Ben L. Clark, 1306 Brookside Dr., Danville, Calif. 94526

[21] Appl. No.: 78,540

[22] Filed: Sep. 24, 1979

[51] Int. Cl.[3] ..... A45D 48/18

[52] U.S. Cl. ..... 132/84 B

[58] Field of Search ..... 132/84; 15/172, 184, 15/132, 92 R; 206/38, 229, 362.2; 401/124

[56] References Cited

U.S. PATENT DOCUMENTS

| | | | |
|---|---|---|---|
| 1,773,041 | 8/1930 | Healy | 132/84 A |
| 1,881,316 | 10/1932 | Horvath | 132/84 R |
| 2,450,002 | 9/1948 | Jackson | 132/84 B |
| 2,968,827 | 1/1961 | Lawsine et al. | 132/84 R |

*Primary Examiner*—G. E. McNeill

*Attorney, Agent, or Firm*—Townsend and Townsend

[57] ABSTRACT

A practical and efficient self-contained toothbrush is disclosed. A brush element is provided which includes a hollow handle and a brush head integral to one end of the handle. The peripheral dimensions of the brush head do not exceed those of the handle when viewed axially. A hollow cap is attachable to the handle so that the cap encloses the brush head. A base is attachable to the end of the handle opposite from the brush head. A dentifrice container is attached to the base at one end and has an opposite end with an opening for the dispensing of dentifrice. The container projects from the base so that the container is located within the hollow handle when the base is attached to the handle. The external peripheral dimensions of the container are contoured to match the internal dimensions of the hollow handle to maximize the size of the container and seal the opening of the container when it is enclosed by the handle.

5 Claims, 7 Drawing Figures

SELF-CONTAINED TOOTHBRUSH

BACKGROUND OF THE INVENTION

The present invention provides a self-contained toothbrush in which all of the elements required for tooth brushing are contained in a convenient unit.

The concept of a self-contained toothbrush is not new. Various self-contained toothbrush designs are contained in U.S. Pat. No. 1,473,766 to Healy; U.S. Pat. No. 1,642,620 to Merrill; U.S. Pat. No. 2,455,600 to Molumby et al.; and U.S. Pat. No. 2,601,244 to Boulicault. However, no such self-contained toothbrushes are known to be available on the commercial market at the present time.

The devices illustrated in the above-identified patents are generally too complex to be practical in a commercial sense. For example, most of the devices require that the brush element be releasably attached to a handle element, and it is difficult to achieve a suitably rigid construction in this fashion, particularly on a mass production basis. Also, the device is generally too expensive to construct to represent a practical alternative to a standard toothbrush in a container. The devices typically do not carry sufficient dentifrice to last for a reasonable period of time. Moreover, the devices are all relatively large and bulky because their diameters must be sufficient to enclose the brush head.

SUMMARY OF THE INVENTION

The present invention provides a practical and efficient self-contained toothbrush. A brush element is provided which includes a hollow handle and a brush head integral to one end of the handle. The peripheral dimensions of the brush head do not exceed those of the handle when viewed axially. A hollow cap is attachable to the handle so that the cap encloses the brush head. A base is attachable to the end of the handle opposite from the brush head. A dentifrice container is attached to the base at one end and has an opposite end with an opening for the dispensing of dentifrice. The container projects from the base so that the container is located within the hollow handle when the base is attached to the handle. The external peripheral dimensions of the container are contoured to match the internal dimensions of the hollow handle to maximize the size of the container and seal the opening of the container when it is enclosed by the handle.

In the preferred embodiment of the present invention, all of the elements of the device have a generally trapezoidal cross-section. The brush head is the one design feature of the device which cannot be reduced in size, and the trapezoidal shape of the elements closely match the exterior dimensions of the brush head. In the preferred embodiment, the elements slideably engage one another for convenient removal and reattachment.

The present invention provides a simple and straightforward design, primarily because the handle is integrally attached to the brush head and need not be assembled from separate elements. The design of the dentifrice container within the handle allows for the carrying of a substantial quantity of dentifrice so that the supply is sufficiently large to be practical. However, the size of the overall device is minimized so that it can be conveniently carried on the person.

The novel features which are characteristic of the invention, as to organization and method of construction, together with further objects and advantages thereof will be better understood from the following description considered in connection with the accompanying drawings in which a preferred embodiment of the invention is illustrated by way of example. It is to be expressly understood, however, that the drawings are for the purpose of illustration and description only and are not intended as a definition of the limits of the invention.

DESCRIPTION OF THE PREFERRED EMBODIMENT

Figures 1, 2, 3, 4, 5, 6, 7:
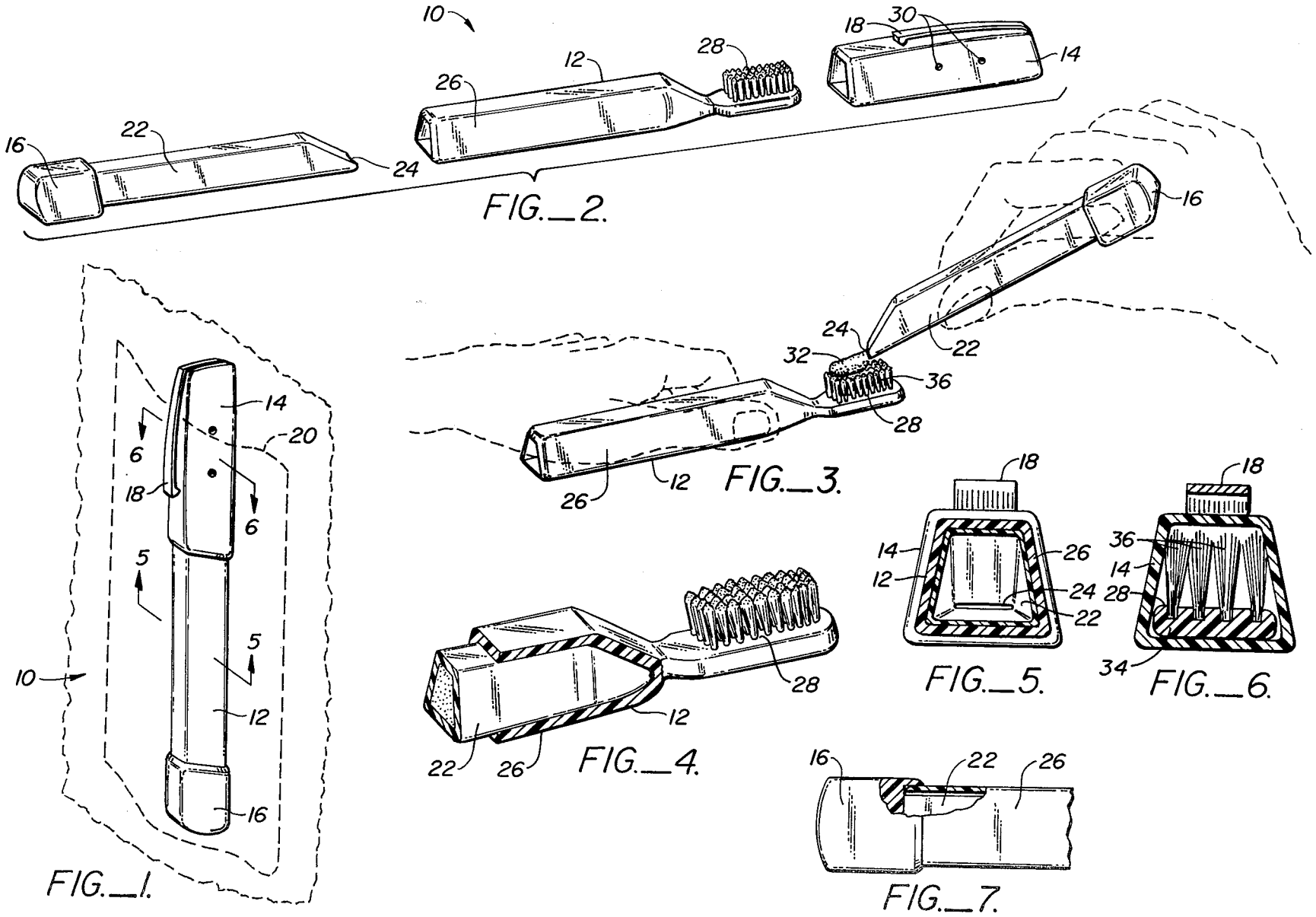
FIG. 1 is a perspective view of a preferred embodiment of the present invention carried on the user's person.
FIG. 2 is an exploded view of the embodiment of FIG. 1.
FIG. 3 is a perspective view illustrating use of the device to apply toothpaste to the brush.
FIG. 4 is a fragmentary cutaway perspective showing the forward end of the dentifrice container.
FIG. 5 is a section view taken along lines 5—5 of FIG. 1.
FIG. 6 is a section view taken along lines 6—6 of FIG. 1.
FIG. 7 is a fragmentary cutaway elevation view of the attachment of the base to the handle.

The preferred embodiment 10 of the self-contained toothbrush of the present invention is illustrated generally by way of reference to FIG. 1. Brush 10 includes a handle element 12, a cap 12, a cap 14 and a base 16 which are normally attached together as one unit. A clip 18 is provided so that toothbrush 10 can be attached to the pocket 20 of the user and carried like a standard fountainpen.

The various elements of toothbrush 10 are illustrated in more detail by way of reference to FIG. 2. Base 16 includes a dentifrice container 22 projecting therefrom. A slit 24 is formed in the distal end of container 22. When assembled, dentifrice container 22 fits within the hollow handle 26 of brush element 12. A brush head 28 is integrally attached to the opposite end of handle 26. A plurality of vents 30 are located in cap 14 to provide ventilation for brush head 28 when the device is assembled.

The manner in which the elements of toothbrush 10 are used to dispense the dentifrice is illustrated by way of reference to FIG. 3. Base 16 is detached from handle 26, and the user holds base 16 and dentifrice container 22 in one hand, and handle 26 in the other. The user simply squeezes container 22 (no cap is needed for the container) and the toothpaste, tooth powder, or other dentifrice 32 is dispensed on brush head 28 through opening 24 in the container.

The handle portion 26 of brush element 12 has a trapezoidal configuration both inside and out, as is illustrated in FIG. 5 with the dentifrice removed. Referring to FIG. 4, dentifrice container 22 is contoured and has an equivalent trapezoidal shape so that the container fits flush within handle 26. The opening 24 at the leading end of container 22 fits snug against the forward end of the hollow interior of handle 26, to seal the opening until the container is removed from the handle.

Referring next to FIG. 6, cap 14 also has a trapezoidal shape both inside and outside so that it can frictionally engage handle 26 when it is slipped over brush head 28.

Brush head 28 includes a base 34 and bristles 36 which, in combination, have a generally trapezoidal shape when viewed axially, and cap 14 readily accommodates the shape of brush head 28.

Base 16 is also frictionally engaged with handle 26, as illustrated in FIG. 7. Base 16 has an interior trapezoidal shape equivalent to that of the exterior of handle 26.

In operation, toothbrush 10 can be carried in its assembled configuration, as depicted in FIG. 1, when not in use. When toothbrush 10 is to be used, brush head 28 is exposed by removing cap 14. Dentifrice can be supplied by removing base 16 and squeezing dentifrice container 22. After the dentifrice has been supplied, base 16 and container 22 can be reinserted in handle 26, and the elements, minus cap 14, used as a standard toothbrush. After use, cap 14 can be reattached so that the device can again be carried conveniently.

While a preferred embodiment of the present invention has been illustrated in detail, it is apparent that modifications and adaptations of that embodiment will occur to those skilled in the art. However, it is to be expressly understood that such modifications and adaptations are within the spirit and scope of the present invention, as set forth in the following claims.

What is claimed is:

1. A self-contained toothbrush comprising: a brush element including a hollow handle and a brush head integral to one end of the handle, the interior and exterior of the hollow handle being generally trapezoidal in section and the peripheral dimensions of the brush head not exceeding those of the handle when viewed axially;

a hollow cap which is generally trapezoidal in interior and exterior section, said hollow cap being frictionally engageable with the handle so that the cap encloses the brush head, the trapezoidal interior dimensions of the cap matching the exterior dimensions of the brush head;

a base which is generally trapezoidal and is frictionally engageable with the end of the handle opposite from the brush head; and a dentifrice container attached to the base at one end and having an opposite end with an opening for the dispensing of dentifrice, said container projecting from the base so that the container is located within the hollow handle when the base is attached to the handle, the exterior peripheral dimensions of the container being generally trapezoidal in section and conformed to match the internal dimensions of the hollow handle to maximize the size of the container and seal the opening of the container when it is enclosed by the handle.

2. A toothbrush as recited in claim 1, wherein the distal end of the container is tapered toward the wide side and the opening comprises a slit along the tip of the container, and wherein the hollow interior of the handle has corresponding dimensions so that the slit is sealed when the container is enclosed within the handle.

3. A toothbrush as recited in claim 1 and additionally comprising a clip attached to the cap to facilitate carrying of the toothbrush on the user's person.

4. A toothbrush as recited in claim 1 and wherein the cap includes small vent holes.

5. A toothbrush as recited in claim 1 wherein the cap and the base frictionally engage the handle and attach thereto so that the toothbrush can be readily disassembled.

* * * * *